United States Patent [19]

Ozu et al.

[11] Patent Number: 4,835,350

[45] Date of Patent: May 30, 1989

[54] HANDLE OPERATING MECHANISM FOR CIRCUIT BREAKERS

[75] Inventors: Tokio Ozu, Akigawa; Taturou Oda; Seietsu Takamatsu, both of Mie; Akira Ogawa, Kuwana, all of Japan

[73] Assignee: Kabushiki Kaisha Toshiba, Kawasaki, Japan

[21] Appl. No.: 170,733

[22] Filed: Mar. 21, 1988

[30] Foreign Application Priority Data

Jun. 26, 1987 [JP] Japan ..... 62-98147[U]

[51] Int. Cl.[4] ..... H01H 9/22

[52] U.S. Cl. ..... 200/50 A

[58] Field of Search ..... 200/50 A, 329, 330, 200/336, 337, 338; 361/343, 344

[56] References Cited

U.S. PATENT DOCUMENTS

| | | | |
|---|---|---|---|
| 2,260,073 | 10/1941 | Ellis | 200/50 A |
| 2,263,760 | 11/1941 | Currie | 200/50 A |
| 2,806,098 | 9/1957 | Portman et al. | 200/50 A |
| 2,894,084 | 7/1959 | Rexroad et al. | 200/50 A |
| 3,009,029 | 11/1961 | Bodenschatz et al. | 200/330 X |
| 3,274,353 | 9/1966 | Daly et al. | 200/50 A |
| 3,324,259 | 6/1967 | Chamberlin, Jr. et al. | 200/50 A |
| 3,697,714 | 10/1972 | Gryctoko et al. | 200/330 |
| 3,970,808 | 7/1976 | Gryctko et al. | 200/337 |

FOREIGN PATENT DOCUMENTS 59-9458 1/1984 Japan .

*Primary Examiner*—J. R. Scott

*Attorney, Agent, or Firm*—Foley & Lardner, Schwartz, Jeffery, Schwaab, Mack, Blumenthal & Evans

[57] ABSTRACT

A circuit breaker includes an operation knob rotatably mounted on a frame, an actuator rotatably mounted on the frame, the actuator being rotatably moved with the operation knob so as to operate a handle of the circuit breaker, an engagement member rotatably movable between first and second positions in response to the reciprocal movement of the actuator. The engagement member engages with an interlocking arm for the locking of the compartment door while it is being moved to the second position. The engagement member allows the interlocking arm to pass by when occupying the first position. An engagement portion is formed in the operation knob so as to engage with the engagement member when it occupies the second position. The location of the engagement portion corresponds to an OFF position of the operation knob where the circuit breaker is opened. Engagement of the engagement member with the engagement portion prevents the circuit breaker from being closed when the compartment door is opened.

1 Claim, 4 Drawing Sheets

HANDLE OPERATING MECHANISM FOR CIRCUIT BREAKERS

BACKGROUND OF THE INVENTION

1. Field of the Invention

The present invention relates generally to circuit breakers incorporated in switchgears such as control centers, and more particularly to a handle operating mechanism for operating an operation handle of the circuit breaker of the switchgear.

2. Description of the Prior Art

In the above-described handle operating mechanism of the circuit breaker incorporated in the switchgear, a knob of the handle is prevented from being moved when a compartment door of the switchgear is opened with the circuit breaker electrically opened by operating the handle knob, thereby preventing the circuit breaker from being electrically closed. When closed, the compartment door of the switchgear is locked to its closed position and the knob is allowed to be operated so that the circuit breaker may be electrically closed.

Japanese Utility Model Laid-open Application No. 599458 discloses such a handle operating mechanism, which is shown in FIG. 7. Referring to FIG. 7, an engagement member 3 is rotatably mounted on the backside wall of a frame 1 with a support shaft 2 interposed therebetween. A cam plate 5 is rotatably moved together with a handle knob 4 mounted on the front wall of the frame 1. When a circuit breaker (not shown) is electrically opened with the compartment door of the switchgear opened, a claw 3*a* of the engagement member 3 is caused to engage with an engagement portion 5*a* of the cam plate 5, as is shown by the solid line in FIG. 7, thereby preventing the cam plate 5 from being rotatably moved to its circuit breaker closing position as shown by the arrow A. Consequently, an actuating member 6 rotatably moved together with the cam plate 5 may be prevented from being rotatably moved, whereby the operation handle inserted in a bow-shaped aperture 6*a* of the actuating member 6 beforehand is not allowed to be moved from its OFF position to its ON position. Whereas, when the compartment door is closed, a projection 3*b* of the engagement member 3 is engaged with an engagement claw 7*a* provided at the distal end of an interlocking arm 7 extending from the backside of the compartment door, as shown by the alternate long and two short dashes line in FIG. 7. When the projection 3*b* is engaged with the engagement claw 7*a*, the engagement member 3 is rotatably moved in the direction of the arrow B against spring force of a torsion coil spring 9 attached to a support shaft 8 of the actuating member 6, thereby disengaging the claw 3*a* from the engagement portion 5*a* of the cam plate 5. The cam plate 5 is thus allowed to be rotatably moved in the direction of the arrow A and accordingly, the circuit breaker may be electrically closed.

As described above, the prior handle operating mechanism comprises independent mechanical parts, that is, the frame 1, operation knob 2, engagement member 3, and a transmission mechanism for transmitting movement of the operation knob 2 to the handle of the circuit breaker, which mechanism comprising independent parts such as the cam plate 5 and the actuating member 6. The prior handle operating mechanism thus has a disadvantage that a large number of parts to be assembled are required. Consequently, the assembly work of the circuit breakers requires much labor, resulting in high production cost.

SUMMARY OF THE INVENTION

Therefore, an object of the present invention is to provide a handle operating mechanism for the circuit breaker incorporated in the switchgear wherein the number of parts to be assembled can be decreased, thereby reducing labor in the assembly work.

The handle operating mechanism for the circuit breaker comprises a frame mounted in a unit compartment of the switchgear provided with a compartment door having an interlocking arm, an operation knob rotatably mounted on the frame, an actuating member rotatably mounted on the frame so as to be rotatably moved together with the knob to thereby operate a handle of the circuit breaker, an engagement member coupled to the actuating member so as to be moved in response to the reciprocally rotatable movement of the actuating member, and means for preventing the operation knob from being rotatably moved to an ON position in cooperation with the engagement member. The engagement member is rotatably moved between first and second positions in response to movement of the actuating member. The engagement member is engageable with the interlocking arm during its travel from the first position to the second position. The interlocking arm is not engaged with the engagement member when the engagement member occupies the first position. In the present invention, an engagement portion directly formed in the operation knob is utilized as the means for preventing the operation knob from being rotatably moved to the ON position in cooperation with the engagement member. The position of the engagement portion formed in the operation knob is determined so as to correspond to an OFF position of the circuit breaker.

According to the above-described construction, the compartment door is locked to its closed position while the circuit breaker is electrically closed as in the prior circuit breaker. The circuit breaker may be prevented from being electrically closed while the compartment door is opened. In order to provide the function of preventing the circuit breaker from being closed while the compartment door is opened, the engagement portion with which the engagement member engages is directly formed in the operation knob. Consequently, the member or part corresponding to the cam plate employed in the prior handle operating mechanism is not required.

Other and further objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

Figure 1:
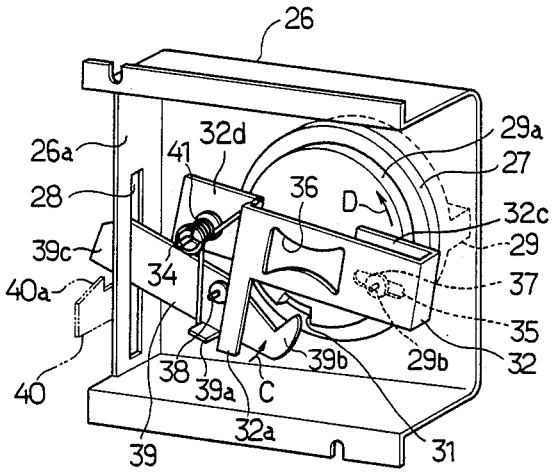
FIG. 1 is a perspective view of the handle operating mechanism in accordance with the present invention, as seen from the backside thereof.
Figure 2:
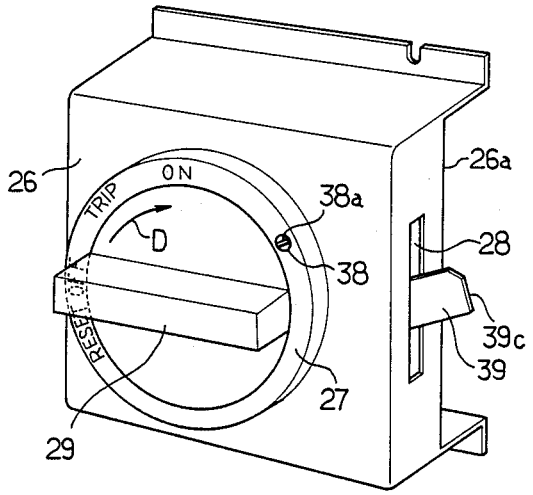
FIG. 2 is a perspective view of the handle operating mechanism as seen from the front side thereof.
Figure 3:
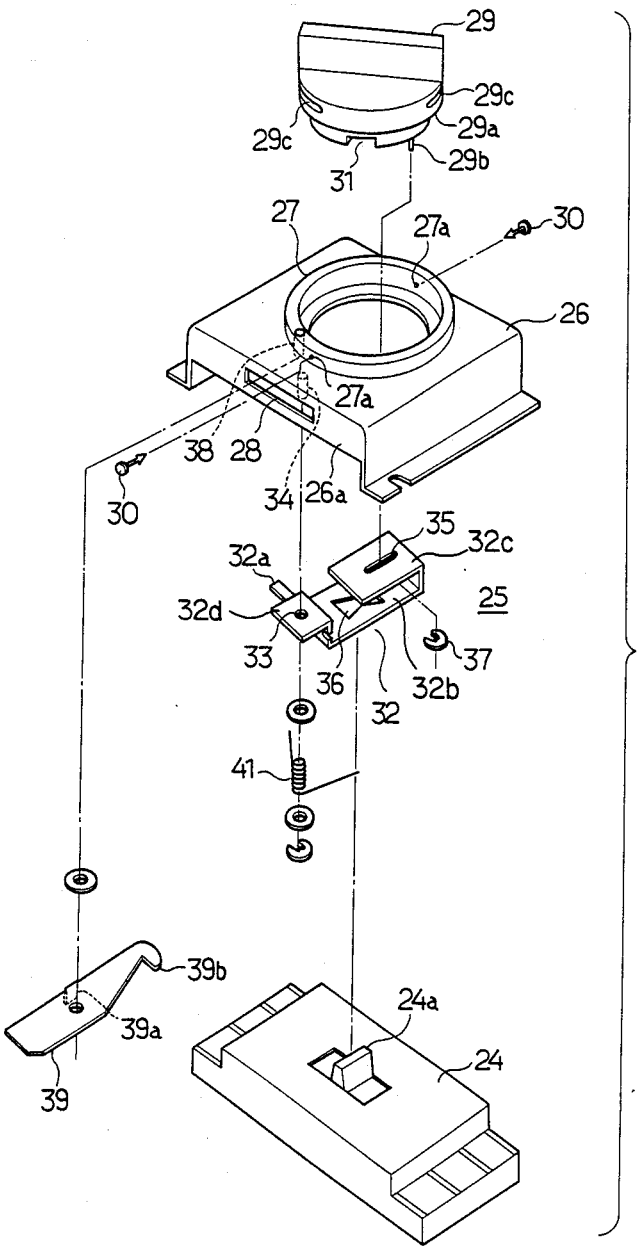
FIG. 3 is an exploded perspective view of the handle operating mechanism and the circuit breaker.
Figure 4:
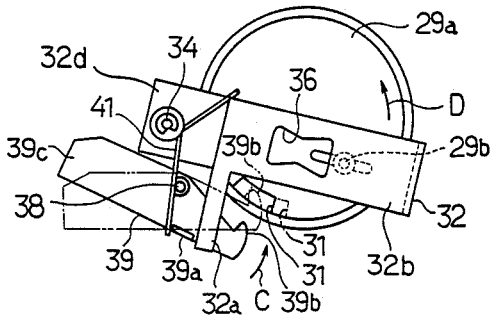
FIG. 4 is a rear elevation of the major portion of the handle operating mechanism wherein the knob is rotatably moved to OFF position.
Figure 5:
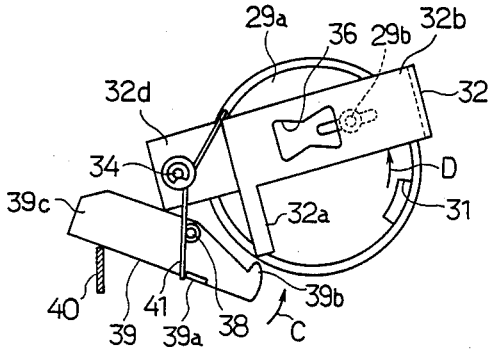
FIG. 5 is also a rear elevation of the major portion of the handle operating mechanism wherein the knob is rotatably moved to ON position.
Figure 6:
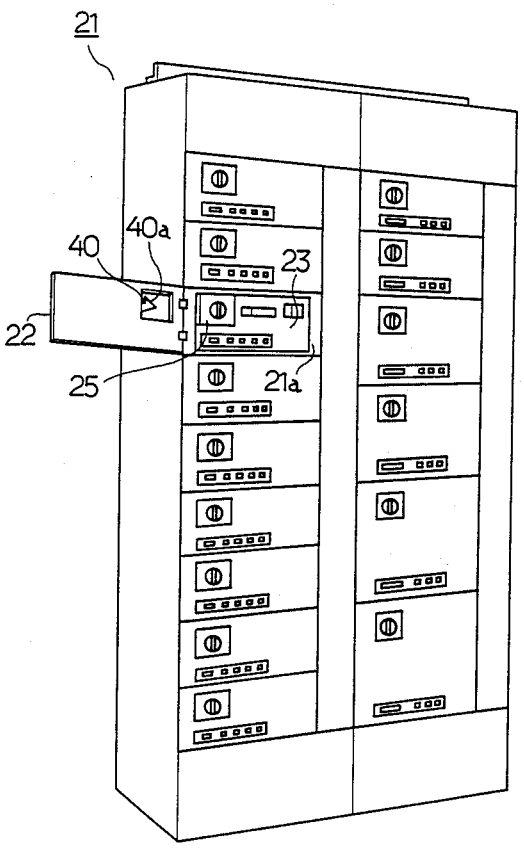
FIG. 6 is a perspective view of a control center.

FIGS. 1-6 illustrate an embodiment of the handle operating mechanism in accordance with the present invention. Referring first to FIG. 6, reference numeral 21 indicates a control center as a metal-clad or metal-enclosed switchgear. The interior of the control center 21 is divided into a plurality of unit compartments such as shown by reference numeral 21*a*. A control unit 23 is enclosed in each unit compartment 21*a*. Each unit compartment 21*a* is provided with a compartment door 22 which is closed and opened. The control unit 23 is provided with a circuit breaker 24 as shown in FIG. 3. The circuit breaker 23 incorporates a handle operating mechanism 25 in accordance with this invention.

Referring now to FIGS. 1-3, reference numeral 26 indicates a frame of the handle operating mechanism 25. A cylindrical portion 27 with a circular step portion is formed at the center of the frame 26 over its entire outer periphery. An elongated slit 28 is formed in a side wall 26*a* of the frame 26. An operation knob 29 has a pin member 29*b* projecting from the pivot point of the backside of a stepped disc portion 29*a*, which is fitted in the cylindrical portion 27 so that the operation knob 29 is supported on the frame 26 for rotatable movement. Elongated grooves 29*c* are formed in an outer periphery of the disc portion 29*a* of the knob 29. Two through apertures 27*a* are formed in the cylindrical portion 27. Pin members 30 are inserted in respective apertures 27*a* from the outside of the cylindrical portion 27 and are secured in position. The pin members 30 are then inserted in the elongated grooves 29*c* respectively so that the knob 29 may be prevented from falling out and so that the rotatable movement of the knob 29 is defined as the range from an ON position to a RESET position through TRIP and OFF positions. Reference numeral 31 indicates an engagement portion formed in the knob 29 and having a generally square U-shaped configuration. The engagement portion 31 constitutes part of means for preventing the operation knob 29 from being moved to the ON position in the event that the compartment door 22 is opened, as will hereinafter be described. The engagement portion 31 is formed by cutting away part of the outer peripheral edge of the disc portion 29*a* of the knob 29. A generally square U-shaped actuating member 32 comprises a long plate portion 36 and two short plate portions 32*c* and 32*d*. A shaft supporting opening 33 is formed in the short plate portion 32*d* of the actuating member 32. A support shaft 34 is inserted in the shaft supporting opening 33 and rotatably supported therein. An elongated aperture 35 is formed in the short plate portion 32*c* of the actuating member 32. A generally bow-shaped aperture 36 is formed in the long plate portion. The long plate portion 32*b* of the actuating member 32 is also provided with a projection 32*a* formed integrally therewith. The pin member 29*b* of the operation knob 29 is inserted in the elongated aperture 35 and then a retaining ring 37 is attached to the pin member 29*b* to prevent the same from falling out of the aperture 35. The insertion of the pin member 29*b* in the elongated aperture 35 allows the actuating member 32 to be rotatably moved about the shaft 34 in response to the rotatable movement of the operation knob 29. An operation handle 24*a* of the circuit breaker 24 is inserted in the aperture 36 of the actuating member 32 and the handle 24*a* is operated by rotatably moving the actuating member 32. Another support shaft 38 is rotatably mounted on the cylindrical portion 27 so as to project at the rear side of the frame 26. A groove 38*a* is formed in the front edge portion of the support shaft 38. The support shaft 38 may be rotatably moved with a tool such as a screw driver which is inserted into the groove 38*a*. An engagement member 39 is secured to the support shaft 38. One end 39*c* of the engagement member 39 is extended out of the frame 26 through the elongated aperture 38 so as to engage with a claw 40*a* of an interlocking arm 40 mounted on the compartment door 22 of the unit compartment 21*a*. See FIGS. 1 and 6. The engagement member 39 is provided with a bent portion 39*a* formed at the middle thereof. The bent portion 39*a* abuts against the projection 32*a* of the actuating member 32. The engagement member 39 has a claw 39*b* formed integrally therewith at the other end thereof. The claw 39*b* is engaged with and disengaged from the engagement portion 31 of the operation knob 29. A torsion coil spring 41 is provided around the support shaft 34 for biasing the engagement member 39 in the direction of the arrow C, as shown in FIGS. 1, 4 and 5. The torsion coil spring 41 allows the engagement member 39 to be rotatably moved between first and second positions in response to rotatable return movement of the actuating member 32, as shown in FIG. 4.

The operation of the above-described handle operating mechanism will now be described. The operation knob 29 occupies the OFF position shown in FIG. 2. When the circuit breaker 24 is electrically opened with the compartment door 22 of the unit compartment 21*a* opened the torsion coil spring 41 causes the engagement member 39 to rotatably move in the direction of the arrow C. The bent portion 39*a* is abutting on the projection 32*a* of the actuating member 32, as shown in FIGS. 1 and 4. That is, the engagement member 39 occupies the first position. In this condition, the engagement member 39 is prevented from being further moved in the direction of the arrow C. Since the claw 39*b* is disengaged from the engagement portion 31 of the knob 29, the knob 29 may be rotatably moved toward the ON position as shown by the arrow D in FIGS. 1 and 4.

When the knob 29 is turned in the direction of the arrow D toward the ON position in the condition shown in FIG. 1 or 4, the engagement of the pin member 29*b* with the aperture 35 causes the actuating member 32 to move in the direction of the arrow D. Consequently, the torsion coil spring 41 causes the engagement member 39 to follow the actuating member 32, moving in the direction of the arrow C. As the result of the rotatable movement of the engagement member 39, the claw 39*b* travels into the engagement portion 31 of the knob 29 which is being moved in the direction of the arrow D when the engagement member 39 is moved to the second position shown by the alternate long and two short dashes line in FIG. 4. Since the claw 39*b* is engaged with the engagement portion 31, further rotatable movement of the knob 29 in the direction of the arrow D may be prevented. Thus, when the knob 29 is rotatably moved from the OFF position in the direction of the arrow D while the compartment door 22 is opened, the engagement member 39 prevents the knob 29 from being moved, so that the knob 29 is not rotatably moved to the ON position. That is, the circuit breaker 24 is not allowed to be electrically closed while the compartment door is opened.

When the compartment door 22 of the unit compartment 21*a* is closed in the condition that the circuit breaker 24 is electrically opened as shown in FIG. 4, the interlocking arm 40 is caused to move forwardly so that a claw portion 40*a* thereof is located beneath one end 39*c* of the engagement member 39 which occupies the first position shown by the solid line in FIG. 4. Since the bent portion 39*a* of the engagement member 39 is abutting against the projection 32*a* of the actuating member 32 such that the engagement member 39 is prevented from being moved in the direction of the arrow C toward the second position, the claw portion 40*a* of the interlocking arm 40 is not engaged with the end 39*c* of the engagement member 39. Accordingly, the compartment door 22 may be free to be opened and closed.

Whereas, the interlocking arm 40 is located beneath the end 39*c* of the engagement member 39 when the compartment door 22 is closed. In this condition, when the knob 29 is rotatably moved in the direction of the arrow D from the OFF position toward the ON position, the actuating member 32 is rotatably moved in the same direction as of the knob 29 and the torsion coil spring 41 causes the engagement member 39 to move from the first position in the direction of the arrow C. The end 39*c* of the engagement member 39 abuts against the interlocking arm 40 before reaching the second position shown by the alternate long and two short dashes line in FIG. 4. The rotatable movement of the engagement member 39 in the direction of the arrow C is prevented by the interlocking arm 40. Consequently, the claw 39*b* of the engagement member 39 is not allowed to travel into the engagement portion 31 of the knob 29 and is kept disengaged from the engagement portion 31, as shown in FIG. 5. Accordingly, the knob 29 is allowed to be rotatably moved when the compartment door 22 is closed, whereby the circuit breaker 24 may be electrically closed and opened. The end 39*c* of the engagement member 39 engages with the claw 40*a* of the interlocking arm 40 when the circuit breaker 24 is electrically closed. The compartment door 22 is held at the closed position and not allowed to be opened.

When the knob 29 is rotatably moved in the direction opposite to arrow D in the condition shown in FIG. 5, the projection 32*a* abuts against the bent portion 39*a*, thereby causing the engagement member 39 to return to the first position. The engagement member 39 is thus disengaged from the interlocking arm 40. Additionally, when the compartment door 22 is required to be opened for the maintenance or inspection during operation of the circuit breaker, the support shaft 38 shown in FIG. 2 may be rotatably moved with a screw driver or the like to thereby disengage the engagement member 39 from the claw 40*a* of the interlocking arm 40.

Figure 7:
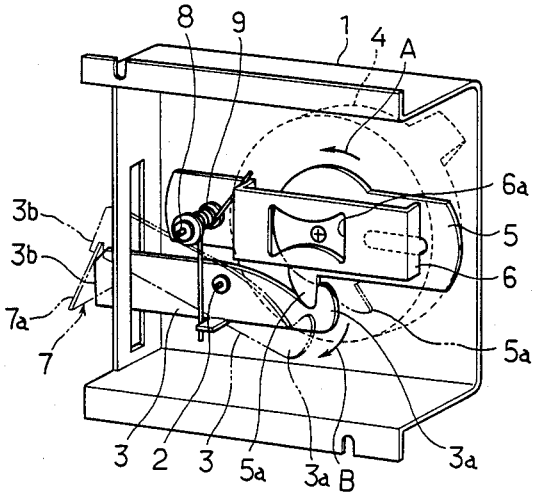
Fig. 7 (PRIOR ART)
FIG. 7 is a view similar to FIG. 1 showing a conventional handle operating mechanism.

According to the above-described embodiment, the rotatable movement of the knob 29 may directly be transmitted to the actuating member 32. Additionally, the engagement portion 31 is directly provided in the knob 29 so as to prevent the knob 29 from being moved toward the ON position in the event that the compartment door 22 is opened. Consequently, the cam plate 5 employed in the prior mechanism shown in FIG. 7 is not required in the above-described embodiment. Consequently, the number of parts to be assembled may be reduced and the handle operating mechanism may be rendered simple. Furthermore, the efficiency of the assembly work may be improved, thereby decreasing the production cost of the circuit breaker.

Although the knob 29 is provided with the pin member 29*b* which engage with the elongated aperture 35 formed in the actuating member 32 in the above-described embodiment, the actuating member 32 may be provided with a pin member engaging with an elongated groove formed in the knob 29. Furthermore, although the engagement portion is provided in the knob 29 by cutting away part thereof, it may be a projection.

The foregoing disclosure and drawings are merely illustrative of the principles of the present invention and are not to be interpreted in a limiting sense. The only limitation is to be determined from the scope of the appended claims.

What is claimed is:

1. A handle operating mechanism for circuit breakers incorporated in a switchgear which is divided into a plurality of unit compartments each provided with a compartment door having an interlocking arm, each circuit breaker being provided with an operation handle, said handle operating mechanism comprising:

(a) a frame mounted in each unit compartment of the switchgear and having a front wall on which a cylindrical portion having front and rear open ends is formed, a cylindrical portion having a projection formed on an inner circumferential wall thereof so as to be inwardly projected;

(b) an operation knob including a disc portion fitted in the cylindrical portion for rotatable movement, a groove formed in an outer periphery of the disc portion so as to be circumferentially elongated by a predetermined length, said projection being inserted into the groove for relative movement therein, an engagement portion directly formed in a part of the disc portion projected to an inside of the frame from the cylindrical portion, and a projection provided on a part of the disc portion facing the inside of the frame so as to be deviated from a center of rotation of the disc portion;

(c) an actuating member having two ends and pivotally mounted, at one end thereof, on the frame in a vicinity of the cylindrical portion and having, at an other end, a slit elongated in an approximately diametrical direction of the cylindrical portion, the projection being inserted into the slit for movement therein, said actuating member having an opening into which the operation handle of each circuit breaker is inserted, and a projection extended from a part thereof in a direction in which the actuating member is rotatably moved;

(d) an engagement member pivotally mounted on the frame in a position that a center thereof is in a proximity of the center of rotation of the actuating member so that the engagement member is rotatably moved between first and second positions within a plane approximately parallel to a plane of rotation of the actuating member, said engagement member having a portion abutting against the projection of the actuating member in a direction that the actuating member is moved to an ON-position, said engagement member having two ends and a claw portion formed at one of the ends thereof, the claw portion being engaged with the engagement portion of the operation knob placed in an OFF position when the engagement member occupies the second position, said claw portion being disengaged from the engagement portion when the engagement member occupies the first position, the other end of the engagement member being outwardly extended from the inside of the frame across a path of movement of the interlocking arm when the door is closed or opened, said path of movement of the interlocking arm being located between the first and second positions of the engagement member, the interlocking arm being engaged with the other end of the engagement member occupying the second position so that the compartment door is prevented from being opened; and (e) a spring member provided between the actuating member and the engagement member in a direction in which the projection presses against the portion so that the actuating member and the engagement member are rotatably moved, whereby the claw portion of the engagement portion and the operation handle are rotatably moved to an open-circuit position.

* * * * *